US011530462B2

(12) United States Patent
Song et al.

(10) Patent No.: US 11,530,462 B2
(45) Date of Patent: Dec. 20, 2022

(54) GRAIN-ORIENTED ELECTRICAL STEEL SHEET AND MANUFACTURING METHOD THEREFOR

(71) Applicant: POSCO, Pohang-si (KR)

(72) Inventors: Dae-Hyun Song, Pohang-si (KR); June Soo Park, Pohang-si (KR); Il-Nam Yang, Pohang-si (KR)

(73) Assignee: POSCO HOLDINGS INC., Seoul (KR)

( * ) Notice: Subject to any disclaimer, the term of this patent is extended or adjusted under 35 U.S.C. 154(b) by 81 days.

(21) Appl. No.: 16/958,278

(22) PCT Filed: Dec. 17, 2018

(86) PCT No.: PCT/KR2018/016034
§ 371 (c)(1),
(2) Date: Jun. 26, 2020

(87) PCT Pub. No.: WO2019/132357
PCT Pub. Date: Jul. 4, 2019

(65) Prior Publication Data

US 2021/0054475 A1 Feb. 25, 2021

(30) Foreign Application Priority Data

Dec. 26, 2017 (KR) ..... 10-2017-0179572

(51) Int. Cl.

| | |
|---|---|
| ***C21D 9/46*** | (2006.01) |
| ***C21D 6/00*** | (2006.01) |
| ***C21D 8/12*** | (2006.01) |
| ***C22C 38/00*** | (2006.01) |
| ***C22C 38/06*** | (2006.01) |
| ***C22C 38/30*** | (2006.01) |
| ***C22C 38/34*** | (2006.01) |
| ***C22C 38/60*** | (2006.01) |
| ***H01F 1/147*** | (2006.01) |

(52) U.S. Cl.
CPC ..... *C21D 9/46* (2013.01); *C21D 6/002* (2013.01); *C21D 6/007* (2013.01); *C21D 6/008* (2013.01); *C21D 8/1222* (2013.01); *C21D 8/1233* (2013.01); *C21D 8/1272* (2013.01); *C22C 38/002* (2013.01); *C22C 38/008* (2013.01); *C22C 38/06* (2013.01); *C22C 38/30* (2013.01); *C22C 38/34* (2013.01); *C22C 38/60* (2013.01); *H01F 1/147* (2013.01); *C21D 2201/05* (2013.01)

(58) Field of Classification Search
CPC .... C21D 2201/05; C21D 6/002; C21D 6/007; C21D 6/008; C21D 8/12; C21D 8/1222; C21D 8/1233; C21D 8/1244; C21D 8/1272; C21D 9/46; C22C 38/00; C22C 38/001; C22C 38/002; C22C 38/004; C22C 38/008; C22C 38/02; C22C 38/04; C22C 38/06; C22C 38/10; C22C 38/30; C22C 38/34; C22C 38/60; H01F 1/147; H01F 1/14775; H01F 1/16
See application file for complete search history.

(56) References Cited

U.S. PATENT DOCUMENTS

| | | | |
|---|---|---|---|
| 3,991,948 | A | 11/1976 | Schober et al. |
| 4,824,493 | A | 4/1989 | Yoshitomi et al. |
| 2013/0306200 | A1 | 11/2013 | Kohno et al. |
| 2015/0170812 | A1 | 6/2015 | Murakami et al. |
| 2016/0108488 | A1 | 4/2016 | Schuster et al. |
| 2017/0121785 | A1 | 5/2017 | Shingaki et al. |

FOREIGN PATENT DOCUMENTS

| | | | | |
|---|---|---|---|---|
| CN | 101238227 | A | | 8/2008 |
| JP | S30-3651 | | | 5/1955 |
| JP | S40-15644 | | | 7/1965 |
| JP | S51-13469 | | | 2/1976 |
| JP | S62-227078 | A | | 10/1987 |
| JP | H02-022421 | A | | 1/1990 |
| JP | H05-295447 | A | | 11/1993 |
| JP | H05-345920 | A | | 12/1993 |
| JP | H06-116643 | A | | 4/1994 |
| JP | H06-86631 | B2 | | 11/1994 |
| JP | H10-140297 | A | | 5/1998 |
| JP | 2000-144248 | A | | 5/2000 |
| JP | 2000-178647 | A | | 6/2000 |
| JP | 2000-192204 | A | | 7/2000 |
| JP | 2001-158914 | A | | 6/2001 |
| JP | 2004-516381 | A | | 6/2004 |
| JP | 2004516381 | A | * | 6/2004 |
| JP | 2009-503265 | A | | 1/2009 |
| JP | 2009-197299 | A | | 9/2009 |
| JP | 2017-95771 | A | | 6/2017 |

(Continued)

OTHER PUBLICATIONS

Chinese Office Action dated Mar. 26, 2021 issued in Chinese Patent Application No. 201880084530.5.
Chinese Office Action dated Nov. 2, 2021 issued in Chinese Patent Application No. 201880084530.5.
Extended European Search Report dated Sep. 7, 2020 issued in European Patent Application No. 18894969.7.
Japanese Office Action dated Aug. 31, 2021 issued in Japanese Application No. 2020-536061.
International Search Report and Written Opinion issued in corresponding International Application No. PCT/KR2018/016034 dated Apr. 3, 2019, with English translation.

* cited by examiner

*Primary Examiner* — Jenny R Wu
(74) *Attorney, Agent, or Firm* — Morgan, Lewis & Bockius LLP

(57) ABSTRACT

The present invention relates to a grain-oriented electrical steel sheet including 2.0 to 6.0 wt % of Si, 0.01 wt % or less (excluding 0 wt %) of C, 0.01 wt % or less (excluding 0 wt %) of N, and 0.005 to 0.1 wt % of Co, and including a balance of Fe and other inevitable impurities.

5 Claims, No Drawings

(56) References Cited

FOREIGN PATENT DOCUMENTS

| | | | | | |
|---|---|---|---|---|---|
| KR | 10-2008-0042860 | A | | 5/2008 | |
| KR | 10-2012-0096036 | A | | 8/2012 | |
| KR | 10-2012-0130172 | A | | 11/2012 | |
| KR | 10-1365653 | B1 | | 2/2014 | |
| KR | 10-2014-0044892 | A | | 4/2014 | |
| KR | 10-1676630 | B1 | | 11/2016 | |
| KR | 10-2017-0074608 | A | | 6/2017 | |
| KR | 20170074608 | A | * | 6/2017 | |
| WO | WO-2012168253 | A1 | * | 12/2012 | ..... C21D 8/1255 |

GRAIN-ORIENTED ELECTRICAL STEEL SHEET AND MANUFACTURING METHOD THEREFOR

CROSS-REFERENCE TO RELATED APPLICATION

This application is the U.S. National Phase under 35 U.S.C. § 371 of International Application No. PCT/KR201/016034 filed on Dec. 17, 2018, which claims the benefit of Korean Application No. 10-2017-0179572 filed on Dec. 26, 2017, the entire contents of each are hereby incorporated by reference.

BACKGROUND OF THE INVENTION

(a) Field of the Invention

The present invention relates to a grain-oriented electrical steel sheet and a manufacturing method thereof. Specifically, the present invention relates to a grain-oriented electrical steel sheet and a manufacturing method thereof, which has low iron loss and excellent magnetic flux density.

(b) Description of the Related Art

A grain-oriented electrical steel sheet is a soft magnetic material having an excellent magnetic property in one direction or a rolling direction because it shows Goss texture in which the aggregation structure of the steel sheet in the rolling direction is {110}<001>. In order to reveal such a texture, complicated processes such as component control in steelmaking, slab reheating and hot rolling process factor control in hot rolling, hot-rolled sheet annealing heat treatment, primary recrystallization annealing, secondary recrystallization annealing, and the like, are required, and need to be very precisely and strictly managed.

Meanwhile, it is also very important to control inhibitors, which are one of factors revealing the Goss texture, that is, crystal grain growth inhibitors inhibiting indiscriminate growth of primary recrystallized grains and allowing only the Goss texture to be grown at the time of generation of the secondary recrystallization. In order to obtain the Goss texture in the secondary recrystallization annealing, growth of all the primary recrystallized grains needs to be inhibited until just before the secondary recrystallization is generated, and in order to obtain sufficient inhibition ability for the inhibition of the growth, an amount of inhibitors needs to be sufficiently large and a distribution of the inhibitors needs to be uniform.

In order to allow the secondary recrystallization to be generated during a high-temperature final annealing process, the inhibitors need to have excellent thermal stability so as to not be easily decomposed. The secondary recrystallization is a phenomenon occurring since the inhibitors inhibiting the growth of the primary recrystallized grains are decomposed in an appropriate temperature section and lose the inhibition ability, at the time of the secondary recrystallization annealing. In this case, specific crystal grains such as Goss crystal grains are rapidly grown in a relatively short time.

Generally, quality of a grain-oriented electrical steel sheet may be evaluated by magnetic flux density and core loss, which are typical magnetic characteristics, and the higher the precision of the Goss texture, the more excellent the magnetic characteristics. In addition, a grain-oriented electrical steel sheet having excellent quality may manufacture an electric power device having high efficiency due to material characteristics, such that miniaturization and efficiency improvement of the electric power device may be accomplished.

The research and development to lower the iron loss of the grain-oriented electrical steel sheet was first carried out from the research and development to increase the magnetic flux density. The initial grain-oriented electrical steel sheet was prepared by using MnS as a grain growth inhibitor and cold rolling twice. The secondary recrystallization was stably formed, but the magnetic flux density was not very high, and the iron loss was also high.

Another method for improving the crystal grain growth inhibition ability is a method of manufacturing a grain-oriented electrical steel sheet using Mn, Se, and Sb as grain growth inhibitors. This method consists of hot slab heating, hot rolling, hot-rolled sheet annealing, primary cold rolling, intermediate annealing, secondary cold rolling, decarburization annealing, and final annealing. This method has the advantage of obtaining a high magnetic flux density due to its high grain growth inhibition ability, but the material itself is made considerably lighter, so it is impossible to undergo only single cold rolling, and cold rolling twice through intermediate annealing is performed. Thus the manufacturing cost increases. In addition, there is a disadvantage in that manufacturing cost is increased because expensive Se is used.

As another method for improving the grain growth inhibiting ability, there is a method for manufacturing a grain-oriented electrical steel sheet characterized by adding Sn and Cr in combination, followed by slab heat treatment, hot rolling, intermediate annealing, cold rolling once or twice, and decarburization annealing, followed by nitrification treatment. However, in this case, since the annealing temperature of the hot-rolled sheet is strictly controlled according to the acid-soluble Al and the nitrogen content of steel, which are very strict manufacturing standards for manufacturing a low-iron loss, high magnetic flux density thin grain-oriented electrical steel sheet. Accordingly, not only can the annealing process of the hot-rolled sheet be complicated, but the oxide layer formed in the decarburization annealing process is formed very densely due to Cr having strong oxygen affinity, so there is a disadvantage in that decarburization is not easy and nitriding is not performed well.

SUMMARY OF THE INVENTION

An exemplary embodiment of the present invention provides a grain-oriented electrical steel sheet having excellent magnetic properties and a method for manufacturing the same by adding Co to increase magnetization of iron to improve the magnetic flux density and increase the specific resistance to reduce the iron loss.

An exemplary embodiment of the present invention provides a grain-oriented electrical steel sheet including 2.0 to 6.0 wt % of Si, 0.01 wt % or less (excluding 0 wt %) of C, 0.01 wt % or less (excluding 0 wt %) of N, 0.005 to 0.1 wt % of Co, and including a balance of Fe and other inevitable impurities.

The grain-oriented electrical steel sheet may further include 0.005 to 0.04 wt % of Al, 0.01 to 0.2 wt % of Mn, 0.01 wt % or less (excluding 0 wt %) of S, 0.005 to 0.045 wt % of P, 0.03 to 0.08 wt % of Sn, 0.01 to 0.05 wt % of Sb, and 0.01 to 0.2 wt % of Cr.

According to an exemplary embodiment of the present invention, a manufacturing method of a grain-oriented electrical steel sheet includes: heating a slab including 2.0 to 6.0 wt % of Si, 0.02 to 0.08 wt % of C, 0.01 wt % or less (excluding 0 wt %) of N, 0.005 to 0.1 wt % of Co, and including balance Fe and other inevitable impurities; producing a hot-rolled sheet by hot rolling the slab; producing a cold-rolled sheet by cold rolling the hot-rolled sheet; performing primary recrystallization annealing for the cold-rolled sheet; and performing secondary recrystallization annealing for the sheet for which the primary recrystallization annealing is completed.

The slab may further include 0.005 to 0.04 wt % of Al, 0.01 to 0.2 wt % of Mn, 0.01 wt % or less (excluding 0 wt %) of S, 0.005 to 0.045 wt % of P, 0.03 to 0.08 wt % of Sn, 0.01 to 0.05 wt % of Sb, and 0.01 to 0.2 wt % of Cr. In the step of heating a slab, the slab may be heated to 1250° C. or less.

In the step of performing primary recrystallization annealing, primary recrystallization annealing may be performed at 800 to 950° C.

In the step of performing secondary recrystallization annealing, the secondary recrystallization may be completed at a temperature equal to or higher than the primary recrystallization annealing temperature and 1210° C. or less.

The grain-oriented electrical steel sheet and the manufacturing method according to an embodiment of the present invention may expect excellent magnetic properties by controlling the content of Co to increase magnetization of iron to improve the magnetic flux density and increase the specific resistance to reduce the iron loss.

DETAILED DESCRIPTION OF THE EMBODIMENTS

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first component, constituent element, or section described below may be referred to as a second component, constituent element, or section, without departing from the range of the present invention.

The terminologies used herein are used just to illustrate a specific exemplary embodiment, but are not intended to limit the present invention. It must be noted that, as used in the specification and the appended claims, the singular forms used herein include plural forms unless the context clearly dictates the contrary. It will be further understood that the term "comprises" or "includes", used in this specification, specifies stated properties, regions, integers, steps, operations, elements, and/or components, but does not preclude the presence or addition of other properties, regions, integers, steps, operations, elements, components, and/or groups.

When referring to a part as being "on" or "above" another part, it may be positioned directly on or above another part, or another part may be interposed therebetween. In contrast, when referring to a part being "directly above" another part, no other part is interposed therebetween.

Unless defined otherwise, all terms including technical and scientific terms used herein have the same meaning as commonly understood by one of ordinary skill in the art to which the present invention belongs. Terms defined in a commonly used dictionary are further interpreted as having a meaning consistent with the relevant technical literature and the present disclosure, and are not to be construed as ideal or very formal meanings unless defined otherwise.

Unless otherwise stated, % means % by weight, and 1 ppm is 0.0001% by weight.

In an exemplary embodiment of the present invention, the meaning of further comprising/including an additional element implies replacing the remaining iron (Fe) by an additional amount of the additional element.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Grain-Oriented Electrical Steel Sheet

An exemplary embodiment of the present invention provides a grain-oriented electrical steel sheet including 2.0 to 6.0 wt % of Si, 0.01 wt % or less (excluding 0 wt %) of C, 0.01 wt % or less (excluding 0 wt %) of N, 0.005 to 0.1 wt % of Co, and including a balance of Fe and other inevitable impurities.

The reason for component limitation of the directional electric steel sheet of the present invention is as follows.

Si: 2.0 to 6.0 wt %

Silicon (Si) is a basic composition of an electrical steel sheet, and plays a role in ameliorating iron loss by increasing specific resistance of the material. In the case in which a content of Si is too small, the specific resistance is decreased, such eddy current loss is increased, and core loss characteristics are thus deteriorated, and at the time of decarbonization nitriding annealing, phase transformation between ferrite and austenite becomes active, such that a primary recrystallization structure is severely damaged. In addition, at the time of high-temperature annealing, the phase transformation between ferrite and austenite is generated, such that secondary recrystallization becomes unstable, and a {110}<001> aggregation structure is severely damaged.

In the case in which the content of Si is too high, at the time of the decarbonization nitriding annealing, $SiO_2$ and $Fe_2SiO_4$ oxide layers may be excessively and densely formed to delay decarbonization behavior. Therefore, phase transformation between ferrite and austenite may be continuously generated during the decarbonization nitriding annealing, such that a primary recrystallization structure may be severely damaged. Nitriding behavior is delayed due to a decarbonization behavior delay effect depending on the formation of the dense oxide layer described above, such that nitrides such as (A,Si,Mn)N, AlN, and the like are not sufficiently formed. Therefore, sufficient crystal grain inhibition ability required for the secondary recrystallization at the time of the high-temperature annealing may not be secured.

In addition, brittleness and a toughness, which are mechanical characteristics of the grain-oriented electrical steel sheet, are increased and decreased, respectively, resulting in an increase in a sheet fracture occurrence rate in a rolling process. Thus, weldability between sheets is deteriorated, such that easy workability may not be secured. Resultantly, when the content of Si is not controlled in the predetermined range described above, formation of the secondary recrystallization becomes unstable. Thus, magnetic characteristics are severely damaged, and workability is also deteriorated.

C: 0.1 wt % or Less

Carbon (C) is an element causing phase transformation between ferrite and austenite to contribute to crystal grain refining and elongation improvement, and is an essential element for improving rolling properties of an electric steel sheet which is very brittle, and thus has poor rolling properties.

However, when it is present in a final product, carbides formed by a magnetic aging effect are precipitated in a product sheet to deteriorate magnetic properties, and thus a content of C needs to be appropriately controlled.

The content of C added in the slab is 0.02 to 0.08 wt %. When a content of C in the slab is less than 0.02 wt % in the range of the content of Si described above, the phase transformation between the ferrite and the austenite is not sufficiently generated, which causes non-uniformity of a slab and a hot-rolled microstructure. Thus a cold rolling property is damaged.

Meanwhile, residual carbon present in the steel sheet after hot-rolled sheet annealing heat treatment activates fixation of potential during cold rolling to increase a shear zone to increase production sites of Goss nucleus. Thereby, for increasing the Goss crystal grain fraction of primary recrystallized microstructure, more C is likely to be beneficial, however, when C is contained in the slab at more than 0.08 wt % within the range of Si content as described above, sufficient decarburization is not obtained in the decarburizing annealing process without addition of a separate process or facility, and also, a secondary recrystallized aggregation structure is severely damaged due to phase transformation therefrom, and furthermore, when applying the final product to electric power equipment, deterioration of magnetic properties is caused by magnetic aging.

The content of C in the final grain-oriented electrical steel sheet is 0.01 wt % or less by decarburization in a process of primary recrystallization annealing.

N: 0.01 wt % or Less

Nitrogen (N) is an important element that reacts with Al to form AlN, and is contained in an amount of 0.01 wt % or less in the slab. When a content of added N exceeds 0.01 wt %, surface defects such as a blister due to nitrogen diffusion are caused in a post-hot-rolling process, and since excessive nitride is formed in a slab state, rolling is not easy to cause a manufacturing cost to be increased.

Meanwhile, N is additionally required in order to form nitrides such as (Al,Si,Mn)N, AlN, (Si,Mn)N, and the like, and the steel is reinforced by performing nitriding in the steel using ammonia gas in the annealing process after the cold rolling. The content of N in the final grain-oriented electrical steel sheet is 0.01 wt % or less.

Co: 0.005 to 0.1 wt %

Cobalt (Co) is an alloying element that is effective in improving the magnetic flux density by increasing the magnetization of iron, and at the same time, reducing iron loss by increasing the specific resistance.

When the content of Co is less than 0.005 wt %, the effect of improving the magnetic flux density is insignificant, and a sufficient effect of reducing iron loss may not be expected. However, when the content of Co exceeds 0.1 wt %, the manufacturing cost is increased due to the high price, and the amount of austenite phase transformation increases, which may negatively affect microstructures, precipitates, and aggregation structure.

The grain-oriented electrical steel sheet according to an exemplary embodiment of the present invention may further include 0.005 to 0.04 wt % of Al, 0.01 to 0.2 wt % of Mn, 0.01 wt % or less of S, 0.005 to 0.045 wt % of P, 0.03 to 0.08 wt % of Sn, 0.01 to 0.05 wt % of Sb, and 0.01 to 0.2 wt % of Cr.

Al: 0.005 to 0.4 wt %

Aluminum (Al) forms AlN that is finely precipitated at the time of hot rolling and hot-rolled sheet annealing, or is combined with Al, Si, and Mn in which nitrogen ions introduced by ammonia gas exist in a solid-dissolved state within steel in an annealing process after cold rolling, thereby forming (Al, Si, Mn) N and AlN-type nitrides, thereby serving as strong crystal grain growth inhibitors.

In the case in which a content of Al is less than 0.005 wt %, the number and a volume of nitrides are significantly low, such that a sufficient effect as the inhibitors may not be expected. And, in the case in which the content of Al exceeds 0.04 wt %, coarse nitrides are formed, such that crystal grain growth inhibition ability is decreased.

Mn: 0.01 to 0.2 wt %

Manganese (Mn) increases the specific resistance to decrease the eddy current loss, resulting in a decrease in entire core loss, similar to Si. In addition, Mn forms a Mn-based sulfide by reacting with S in a fired steel state, or forms a precipitate of (A,Si,Mn)N by reacting to nitrogen introduced by the nitriding together with Si. Therefore, Mn is an important element in inhibiting growth of primary recrystallized grains and generating the secondary recrystallization. In the case in which a content of Mn is less than 0.01 wt %, the number and a volume of precipitates are significantly low, such that a sufficient effect as the inhibitors may not be expected. And, in the case in which the content of Mn exceeds 0.2 wt %, large amounts of (Fe, Mn) and Mn oxides are formed in addition to $Fe_2SiO_4$ on a surface of the steel sheet to hinder the base coating from being formed during the high-temperature annealing, resulting in deterioration of surface quality. Since phase transformation between ferrite and austenite is caused in a high-temperature annealing process, the aggregation structure is severely damaged, such that the magnetic characteristics are significantly deteriorated.

S: 0.01 wt % or Less

When a content of sulfur (S) exceeds 0.01%, precipitates of MnS are formed in the slab to inhibit crystal grain growth. In addition, S is segregated at a central portion of the slab at the time of casting, such that it is difficult to control a microstructure in the subsequent process. Therefore, when MnS is not used as a grain growth inhibitor, S may not be added over inevitable content or more.

P: 0.005 to 0.045 wt %

Phosphorus (P) may be segregated in a crystal grain boundary to prevent movement of the crystal grain boundary, and simultaneously have an auxiliary role to inhibit crystal grain growth, and in terms of microstructure, P has an effect of improving the {110}<001> aggregation structure.

When the content of P is less than 0.005 wt %, the addition thereof is ineffective, and when P is added more than 0.045 wt %, brittleness is increased to greatly deteriorate rolling properties.

Sn: 0.03 to 0.08 wt %

Tin (Sn), which is a grain boundary segregated element, similar to P, is an element hindering movement of grain boundaries, and is thus known as a crystal grain growth inhibitor. In a predetermined range of the content of Si of the present invention, crystal grain growth inhibition ability for smooth secondary recrystallization behavior at the time of the high-temperature annealing is insufficient. Thus, Sn segregated in the grain boundaries to hinder the movement of the grain boundaries is necessarily required.

When the content of Sn is less than 0.03 wt %, an improvement effect of the magnetic characteristics is slight. However, in the case in which the content of Sn is 0.08 wt % or more, when a temperature increase speed is not adjusted or maintained for a predetermined time in a primary recrystallization annealing section, crystal grain growth inhibition ability is excessively strong, such that stable secondary recrystallization may not be obtained.

Sb: 0.01 to 0.05 wt %

Antimony (Sb) is segregated in the grain boundaries to inhibit crystal grain growth, similar to P, and stabilizes the secondary recrystallization. However, Si has a low melting point, and may thus be easily diffused to the surface during the primary recrystallization annealing to hinder decarbonization, formation of an oxide layer, and nitriding. Therefore, when Sb is added at a predetermined level or more, it hinders the decarburization and inhibits the formation of the oxide layer that becomes the base of the base coating, and thus there is an upper limit in a content of added Sb.

When the content of Sb is less than 0.01 wt %, an improvement effect of the crystal grain growth inhibition is slight. However, in the case in which the content of Sb is 0.05 wt % or more, the crystal grain growth inhibition effect and diffusion of Sb to the surface becomes severe, such that stable secondary recrystallization is not obtained and the surface quality may be deteriorated.

Cr: 0.01 to 0.2 wt %

Chromium (Cr) promotes formation of a hard phase in a hot-rolled annealed sheet to promote formation of the {110}<001> aggregation structure at the time of the cold rolling. In addition, Cr promotes decarburization in a decarburization annealing process to decrease an austenite phase transformation maintaining time, resulting in prevention of damage to the aggregation structure. Cr promotes formation of an oxide layer of a surface formed in the decarbonization annealing process to complement a disadvantage that formation of the oxide layer is hindered due to Sn and Sb.

In the case in which a content of Cr is less than 0.01 wt %, the effect described above is slight. In addition, in the case in which the content of Cr exceeds 0.2 wt %, the formation of the oxide layer is deteriorated in the decarbonization annealing process, and the decarbonization and the nitriding are hindered.

Method for Manufacturing a Grain-Oriented Electrical Steel Sheet

An exemplary embodiment of the present invention provides a method for manufacturing a grain-oriented electrical steel sheet including: heating a slab including 2.0 to 6.0 wt % of Si, 0.02 to 0.08 wt % of C, 0.01 wt % or less (excluding 0 wt %) of N, and 0.005 to 0.1 wt % of Co, and including a balance of Fe and other inevitable impurities; producing a hot-rolled sheet by hot rolling the slab; producing a cold-rolled sheet by cold rolling the hot-rolled sheet; performing primary recrystallization annealing for the cold-rolled sheet; and performing secondary recrystallization annealing for the sheet for which the primary recrystallization annealing is completed.

In the method for manufacturing a grain-oriented electrical steel sheet according to an exemplary embodiment of the present invention, the slab may further include 0.005 to 0.04 wt % of Al, 0.01 to 0.2 wt % of Mn, 0.01 wt % or less of S, 0.005 to 0.045 wt % of P, 0.03 to 0.08 wt % of Sn, 0.01 to 0.05 wt % of Sb, and 0.01 to 0.2 wt % of Cr.

As for the composition of slab, the reason for limiting the composition of the grain-oriented electrical steel sheet described above has been described in detail, so a duplicated description omitted. In the method for manufacturing of the grain-oriented electrical steel sheet, components other than C and N are substantially unchanged.

First, the slab is heated. When the slab is reheated, it may be heated to 1250° C. or lower. Depending on the stoichiometric relationship between Al and N, M and S solid-dissolved due to slab heating, precipitates of an Al-based nitride or a Mn-based sulfide may be made to be incompletely solubilized or completely solubilized.

Next, when the heating of the slab is completed, normal hot rolling is performed so that the thickness of the hot-rolled sheet is 1.0 to 3.5 mm. Thereafter, after the hot-rolled sheet annealing is performed or omitted, single cold rolling or two or more cold-rolling processes with intermediate annealing are performed so that the thickness of the cold-rolled sheet is 0.1 to 0.5 mm.

The cold-rolled sheet is subjected to decarburization annealing, recrystallization of a modified structure, and nitriding treatment using ammonia gas. Further, in precipitation of (Al, Si, Mn)N, AlN, and the like as an inhibitor by introducing nitrogen ions to the steel sheet by using ammonia gas, there is no problem in showing the effects of the present invention whether nitriding treatment is carried out using ammonia gas after decarburization annealing and recrystallization, or ammonia gas is used at the same time so that decarburization annealing and nitriding treatment are carried out together. In the decarburization annealing, recrystallization, and nitriding treatment, the annealing temperature of the steel sheet may be in a range of 800 to 950° C.

When the annealing temperature of steel sheet is less than 800° C., it takes a long time for decarburization, and when the temperature is above 950° C., recrystallized grains grow coarsely to deteriorate a crystal growth driving force so that stable secondary recrystallized grains are not formed. Further, though the annealing time is not a big problem for showing the effects of the present invention, the annealing time may be adjusted within 5 minutes considering productivity.

Immediately before or after the decarburization nitriding annealing heat treatment ends, a portion or the entirety of an oxide layer present in an outer oxide layer formed on a surface of the steel sheet decarbonization-nitriding-annealed may be reduced and removed under a reducing atmosphere, and then an annealing separating agent based on MgO is applied to the steel sheet. Then, final annealing may be performed on the steel sheet for a long time to generate the secondary recrystallization, thereby forming a {110}<001> structure in which a {110} surface of the steel sheet is in parallel with a rolled surface and a <001> direction is in parallel with a rolling direction.

Thereafter, in the step of secondary recrystallization annealing, the secondary recrystallization annealing may be completed at the primary recrystallization annealing temperature or higher, and 1210° C. or lower. Main objects of the secondary recrystallization annealing are to form the {110}<001> structure by the secondary recrystallization, give an insulation property by forming a glass film by an reaction between the oxide layer formed at the time of decarburization and MgO, and remove impurities damaging the magnetic characteristics. As a secondary recrystallization annealing method, an atmosphere including a mixed gas of nitrogen and hydrogen may be maintained in a temperature increase section before the secondary recrystallization is generated, thereafter, a nitride, which is a grain growth inhibitor, may be protected to allow the secondary recrystallization to be grown well, and then, after the secondary recrystallization is completed, the steel sheet is maintained for a long time under a 100% hydrogen atmosphere.

Hereinafter, examples of the present invention and comparative examples are described. However, the following examples are only exemplary embodiments of the present disclosure, and the present invention is not limited to the following examples.

Examples

A slab, which includes C: 0.05 wt %, N: 0.0042 wt %, Al: 0.028 wt %, P: 0.028 wt %, S: 0.004 wt %, Sn: 0.07 wt %, Sb: 0.028 wt %, and Cr: 0.03 wt %, and includes Si and Co as shown in Table 1, was heated to a temperature of 1150° C., and then hot-rolled to a thickness of 2.3 mm. A hot-rolled plate was heated to a temperature of 1085° C., was maintained at 920° C. for 160 seconds, and was then quenched in water. After annealing the hot-rolled sheet, the hot-rolled annealed sheet was pickled and was then rolled once to a thickness of 0.23 mm. The cold-rolled sheet was maintained under a mixed gas atmosphere of humid hydrogen, nitrogen, and ammonia at a temperature of 860° C. for 200 seconds to perform a simultaneous decarburization nitriding annealing heat treatment so that a content of carbon was 30 ppm and nitrogen was 170 ppm.

MgO, which is an annealing separating agent, was applied to the steel sheet to secondarily recrystallization anneal the steel sheet, the secondary recrystallization annealing was performed under a mixed atmosphere of 25% nitrogen+75% hydrogen at a temperature up to 1200° C., and after a temperature of the steel sheet arrived at 1200° C., the steel sheet was maintained for 10 or more hours under a 100% hydrogen atmosphere and was then furnace-cooled. Measurement values of magnetic characteristics in the respective conditions are illustrated in Table 1.

TABLE 1

| Si (wt %) | Co (wt %) | Iron Loss ($W_{17/50}$, W/kg) | Magnetic Flux density (B8, Tesla) | Division |
|---|---|---|---|---|
| 3.33 | 0 | 0.828 | 1.9 | Comparative Example 1 |
| 3.33 | 0.0045 | 0.829 | 1.904 | Comparative Example 2 |
| 3.33 | 0.0136 | 0.795 | 1.927 | Inventive Example 1 |
| 3.33 | 0.0237 | 0.789 | 1.932 | Inventive Example 2 |
| 3.33 | 0.048 | 0.776 | 1.936 | Inventive Example 3 |
| 3.33 | 0.0981 | 0.782 | 1.939 | Inventive Example 4 |
| 3.33 | 0.116 | 0.879 | 1.899 | Comparative Example 3 |
| 3.33 | 0.14 | 0.87 | 1.892 | Comparative Example 4 |
| 3.33 | 0.208 | 0.866 | 1.881 | Comparative Example 5 |
| 3.33 | 0.283 | 0.866 | 1.88 | Comparative Example 6 |
| 3.38 | 0 | 0.824 | 1.902 | Comparative Example 7 |
| 3.38 | 0.0035 | 0.83 | 1.901 | Comparative Example 8 |
| 3.38 | 0.0143 | 0.788 | 1.931 | Inventive Example 5 |
| 3.38 | 0.0233 | 0.78 | 1.927 | Inventive Example 6 |
| 3.38 | 0.0473 | 0.778 | 1.934 | Inventive Example 7 |

TABLE 1-continued

| Si (wt %) | Co (wt %) | Iron Loss ($W_{17/50}$, W/kg) | Magnetic Flux density (B8, Tesla) | Division |
|---|---|---|---|---|
| 3.38 | 0.082 | 0.784 | 1.937 | Inventive Example 8 |
| 3.38 | 0.117 | 0.872 | 1.899 | Comparative Example 9 |
| 3.38 | 0.147 | 0.874 | 1.894 | Comparative Example 10 |
| 3.38 | 0.21 | 0.875 | 1.881 | Comparative Example 11 |
| 3.38 | 0.284 | 0.874 | 1.871 | Comparative Example 12 |
| 3.41 | 0 | 0.821 | 1.903 | Comparative Example 13 |
| 3.41 | 0.0033 | 0.846 | 1.90 | Comparative Example 14 |
| 3.41 | 0.0143 | 0.784 | 1.93 | Inventive Example 9 |
| 3.41 | 0.0241 | 0.778 | 1.922 | Inventive Example 10 |
| 3.41 | 0.0474 | 0.764 | 1.939 | Inventive Example 11 |
| 3.41 | 0.0836 | 0.778 | 1.933 | Inventive Example 12 |
| 3.41 | 0.11 | 0.864 | 1.899 | Comparative Example 15 |
| 3.41 | 0.151 | 0.859 | 1.892 | Comparative Example 16 |
| 3.41 | 0.172 | 0.86 | 1.881 | Comparative Example 17 |
| 3.41 | 0.283 | 0.855 | 1.878 | Comparative Example 18 |
| 3.43 | 0 | 0.822 | 1.903 | Comparative Example 19 |
| 3.43 | 0.0042 | 0.855 | 1.897 | Comparative Example 20 |
| 3.43 | 0.0132 | 0.788 | 1.93 | Inventive Example 13 |
| 3.43 | 0.0243 | 0.779 | 1.924 | Inventive Example 14 |
| 3.43 | 0.0479 | 0.759 | 1.932 | Inventive Example 15 |
| 3.43 | 0.0901 | 0.778 | 1.934 | Inventive Example 16 |
| 3.43 | 0.118 | 0.855 | 1.898 | Comparative Example 21 |
| 3.43 | 0.15 | 0.85 | 1.892 | Comparative Example 22 |
| 3.43 | 0.19 | 0.868 | 1.884 | Comparative Example 23 |
| 3.43 | 0.284 | 0.863 | 1.874 | Comparative Example 24 |
| 3.46 | 0 | 0.814 | 1.902 | Comparative Example 25 |
| 3.46 | 0.0033 | 0.853 | 1.899 | Comparative Example 26 |
| 3.46 | 0.0131 | 0.783 | 1.935 | Inventive Example 17 |
| 3.46 | 0.025 | 0.771 | 1.93 | Inventive Example 18 |
| 3.46 | 0.0476 | 0.774 | 1.939 | Inventive Example 19 |
| 3.46 | 0.0893 | 0.775 | 1.937 | Inventive Example 20 |
| 3.46 | 0.114 | 0.856 | 1.899 | Comparative Example 27 |
| 3.46 | 0.157 | 0.858 | 1.896 | Comparative Example 28 |
| 3.46 | 0.194 | 0.864 | 1.886 | Comparative Example 29 |
| 3.46 | 0.241 | 0.865 | 1.88 | Comparative Example 30 |

In Table 1, the iron loss ($W_{17/50}$) is the average loss (W/kg) in the rolling direction and the vertical rolling direction when a magnetic flux density of 1.7 Tesla is induced at a frequency of 50 Hz, and the magnetic flux density ($B_8$) is the magnitude (Tesla) of the induced magnetic flux density when a magnetic field of 800 Nm is induced.

As can be seen from Table 1, in the case of Inventive Examples 1 to 20, the composition range of the present invention was satisfied and the content of 0.005 to 0.1 wt % of Co were satisfied, and they showed excellent effects of iron loss and magnetic flux density.

On the other hand, in the case of Comparative Examples 1, 2, 7, 8, 13, 14, 19, 20, 25, and 26, they contained the content of Co that was less than 0.005 wt %, so that they showed iron loss and magnetic flux density were worse than those of the inventive examples.

On the other hand, in the case of Comparative Examples 3 to 6, 9 to 12, 15 to 18, 21 to 24, and 27 to 30, they contained the content of Co that was more than 0.1 wt %, so that they showed iron loss and magnetic flux density that were worse than those of the inventive examples.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A grain-oriented electrical steel sheet comprising, 2.0 to 6.0 wt % of Si, 0.01 wt % or less, excluding 0 wt %, of C, 0.01 wt % or less, excluding 0 wt % of N, and 0.0131 to 0.0981 wt % of Co, 0.005 to 0.04 wt % of Al, 0.01 to 0.2 wt % of Mn, 0.01 wt % or less, excluding 0 wt %, of S, 0.005 to 0.045 wt % of P, 0.03 to 0.08 wt % of Sn, 0.01 to 0.05 wt % of Sb, and 0.01 to 0.2 wt % of Cr, and comprising a balance of Fe and other inevitable impurities.

2. A method for manufacturing the grain-oriented electrical steel sheet, comprising:

heating a slab comprising 2.0 to 6.0 wt % of Si, 0.01 wt % or less, excluding 0 wt %, of C, 0.01 wt % or less, excluding 0 wt % of N, and 0.0131 to 0.0981 wt % of Co, 0.005 to 0.04 wt % of Al, 0.01 to 0.2 wt % of Mn, 0.01 wt % or less, excluding 0 wt %, of S, 0.005 to 0.045 wt % of P, 0.03 to 0.08 wt % of Sn, 0.01 to 0.05 wt % of Sb, and 0.01 to 0.2 wt % of Cr, and comprising a balance of Fe and other inevitable impurities;

producing a hot-rolled sheet by hot rolling the slab;

producing a cold-rolled sheet by cold rolling the hot-rolled sheet;

performing primary recrystallization annealing for the cold-rolled sheet; and performing secondary recrystallization annealing for the sheet for which the primary recrystallization annealing is completed, thereby producing the grain-oriented electrical steel sheet of claim 1.

3. The method for manufacturing a grain-oriented electrical steel sheet of claim 2, wherein in the heating the slab, the slab is heated to 1250° C. or less.

4. The method for manufacturing a grain-oriented electrical steel sheet of claim 2, wherein in the performing primary recrystallization annealing, the primary recrystallization annealing is performed at 800 to 950° C.

5. The method for manufacturing a grain-oriented electrical steel sheet of claim 4, wherein in the performing secondary recrystallization annealing, the secondary recrystallization is completed at a temperature equal to or higher than the primary recrystallization annealing temperature, and 1210° C. or less.

* * * * *